United States Patent [19]

Ahlström

[11] 4,046,242

[45] Sept. 6, 1977

[54] VENDING MACHINE OPERATED BY A CHECK TICKET TO RECORD USE THEREON

[76] Inventor: Allan Ahlström, Mahults Herrgard, Simlangsdalen, Sweden, 31038

[21] Appl. No.: 690,198

[22] Filed: May 26, 1976

[30] Foreign Application Priority Data

June 2, 1975 Sweden ..... 7415651

[51] Int. Cl.[2] ..... G07F 7/08

[52] U.S. Cl. ..... 194/4 R

[58] Field of Search ..... 194/4 R, 4 D; 221/7; 235/61.7 B, 61.12 M; 340/147 R

[56] References Cited

U.S. PATENT DOCUMENTS 3,648,241 3/1972 Naito et al. ..... 194/4 X

*Primary Examiner*—Stanley H. Tollberg

*Attorney, Agent, or Firm*—Cantor and Singer

[57] ABSTRACT

A vending machine having a number of compartments is operable by a check ticket, which is inserted in a slot in the machine. Each compartment is blocked by a gate plate, which is swingable outwards/upwards to permit the removal of the goods. This movement is, by way of a linkage, transferred to an embossing mechanism, which makes a mark upon the ticket at a particular spot for each compartment being opened. The linkage includes a catching device which prevents operation unitl a detent therein is magnetically operated by the check ticket.

5 Claims, 5 Drawing Figures

VENDING MACHINE OPERATED BY A CHECK TICKET TO RECORD USE THEREON

BACKGROUND OF THE INVENTION

There are many kinds of vending machines, where the goods are made available upon a payment being made. The most common ones are the coin-in a slot machines, which, however, suffer from certain disadvantages. On the one hand they are expensive to manufacture and, it is often, difficult to combine the price of the goods with the kind of coin suitable for the machine, and furthermore the accumulation of coins in a machine, which is not regularly watched, will always be a temptation to burglary.

SUMMARY OF THE INVENTION

The aim of the present invention is to propose a vending machine comprising a number of individually blocked compartments, and having a catching mechanism which can be released by the use of a special kind of check ticket, upon which a mechanism, operable by the blocking means at the compartments, will make a mark showing the, or those, compartments having been opened.

The invention is especially suited to be used for the distribution of beverages in the rooms of hotels and at other localities, where the public has access, and where it is possible to check the persons being in a position to use a particular machine and where it is possible to secure payment for the check ticket.

DESCRIPTION OF THE PREFERRED EMBODIMENT

Figure 1:
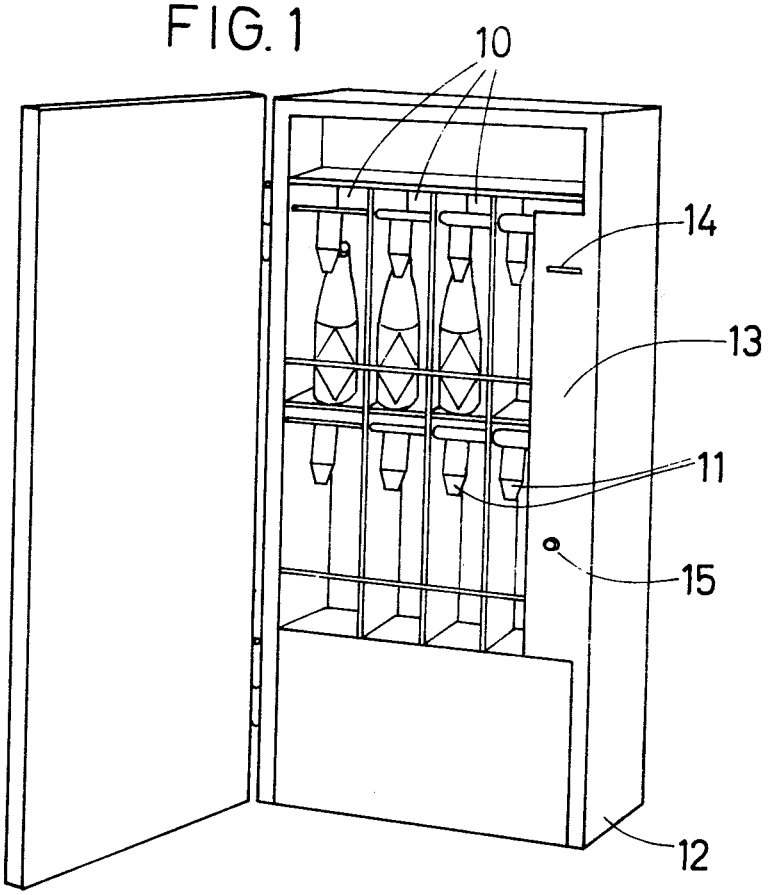
FIG. 1 shows a vending machine suitable for the distribution of beverages and formed as a refrigerator, FIG. 2 schematically shows the blocking means and part of the operating mechanism pertaining to one row of compartments.

The machine shown in FIG. 1 is particularly suited to be mounted in hotel rooms and is provided with eight compartments 10 arranged in two superimposed rows. The compartments are here dimensioned to receive bottles of conventional size, and the unit is fitted into a cabinet having a refrigerating equipment (not shown) built into its lower portion 12.

At each compartment a rotatable blocking plate 11 is provided, which in the manner to be described below will be maintained in blocking position, but which will be released by means of a special type of check ticket. A catching device is mounted in a box 13 at the right hand side of the cabinet. At the front panel of this box, there is a slot 14 for the check ticket, as well as a signal lamp 15.

Each blocking plate 11 is mounted upon, and is rotatable together with a horizontal shaft 16. At the end of each shaft, extending into the box there is cam 17.

As there are four compartments in each row, the shafts are preferably concentrically mounted, the one 16[1], belonging to the compartment located at the left hand side of the row extending past all the other compartments, and having its excenter cam 17[1] located in the outermost righ hand position within box 13.

Figure 2:
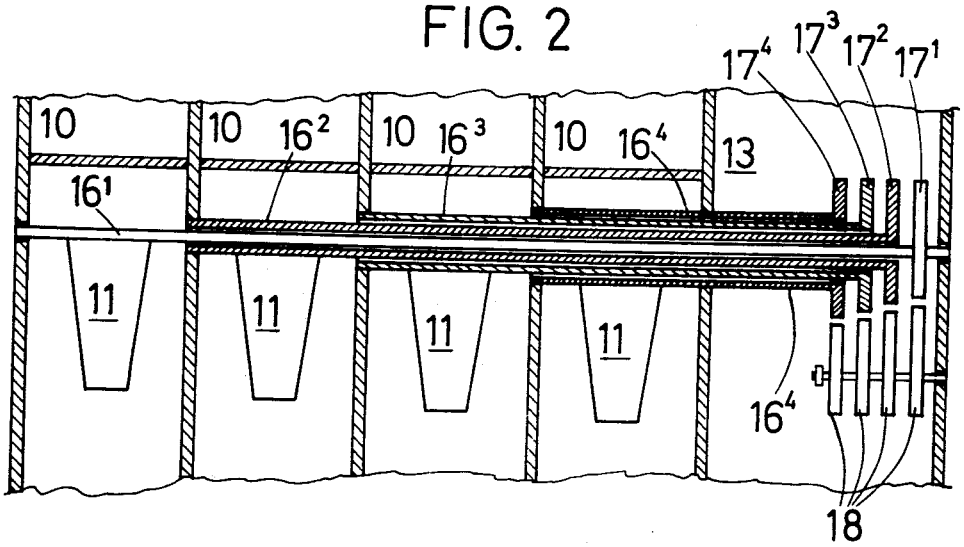
Figure 3:
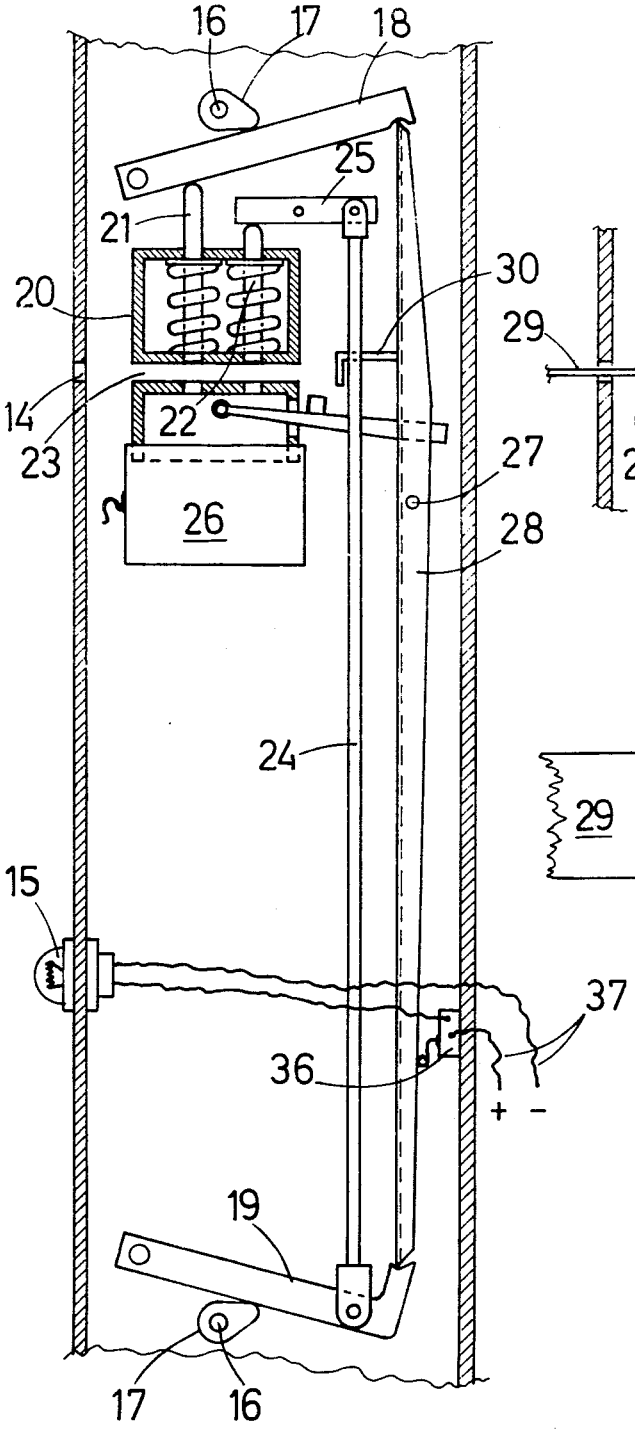
FIG. 3 is a side view of the operating mechanism.

This part of the mechanism is similar at the upper and the lower row of compartments. As is best evident from FIG. 3 the cams 17 will actuate one-armed levers 18 and 19, respectively. These are at the upper row located below the corresponding cams, but are located above the corresponding cams at the lower row. FIG. 2, thus shows a part of the mechanism belonging to the upper row.

By means of these levers 18 and 19 it is possible to actuate an embossing mechanism, generally denoted by 20, and having eight embossing stamps 21, 22, arranged in two rows of four.

The embossing mechanism is provided with a slot 23, which is arranged in a manner to form a continuation of slot 14 in the front panel of box 13. The embossing stamps in the foremost row are arranged to be individually actuated by levers 18.

The second row of stamps 22 is individually actuated by levers 19 by way of push rods 24 and two-armed levers 25.

Directly below the stamps there is a box 26 for collecting the rounds stamped out of the check tickets.

In order to prevent an unauthorized use of the machine, the levers 18 and 19 are blocked by means of a member, which includes a plate 28 swingably mounted upon a shaft 27, located intermediate its ends. In blocking position the ends of this plate will engage levers 18 and 19, preventing movements thereof.

In order to set the levers free the plate must be swung clockwise, as shown. This movement is initiated by insertion of a check ticket 29 through slots 14 and 23 until it reaches a finger 30 mounted upon plate 28.

It is evident that the mechanism should not be operated by means of any flat object, which could be inserted through slots 14 and 23.

Plate 28 is blocked by a release mechanism including a magnet 32 mounted upon a swingable arm 31. An extended portion of this arm passes through an opening 33 in plate 28, and is formed with a notch 34 cooperating with the part of the plate surrounding the opening. The extended portion is so long that it will never leave opening 33 during the swinging movement of plate 28. The plate is balanced in such a manner that it will automatically return to blocking position, when the check ticket is retracted, whereupon notch 34 will engage the plate.

Figure 4:
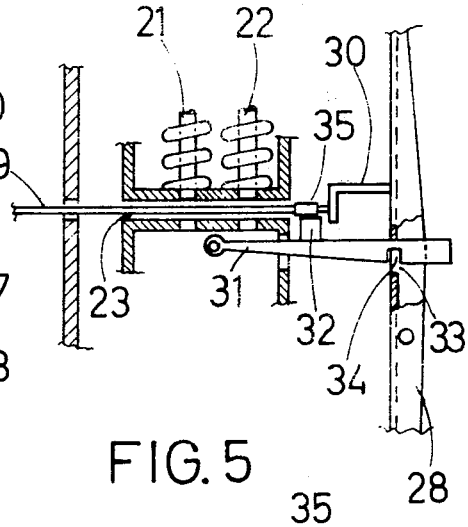
FIG. 4 shows a detail of the mechanism, likewise viewed from the side.
Figure 5:
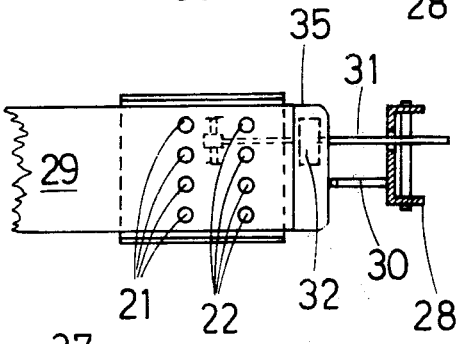
FIG. 5 shows the detail of FIG. 4 as viewed from above.

A characterizing feature of the check ticket 29 is thus that it in a given position is provided with a piece 35 of magnetically attractible material. This may be bonded to one face of the ticket or may be concealed within the ticket, which then is made of two-ply material. As is best shown in FIG. 4 magnet 32 will be lifted upwards when the ticket is introduced sufficiently to make its inward edge reach finger 30. Hereby notch 34 is lifted out of engagement with plate 28, and the ticket may be pushed somewhat further inwards, thereby swinging plate 28 clockwise.

All compartments will now be available, and it is possible to take out the content of any or several compartments.

On each occasion a blocking plate 11 is swung upwards, which is necessary in order to extract anything from the compartment therebehind, a corresponding embossing stamp 21 and 22 will perform an embossing against the ticket.

If the content of a bottle is not consumed immediately, and it is desirable to maintain the bottle cold, the bottle may be returned to its compartment. Each stamp will punch a hole in the ticket at a particular position only, and once a position has been marked for a certain compartment, it does not matter how many further times the stamp is actuated at that particular spot.

On the present occasion there are two rows of compartments, and it is then possible to have, for instance, differently priced goods in the two rows as stamps 21 and 22 will have their marks at different distances from the forward edge of the ticket.

Within the same row it is further possible to have goods with the same price in the two inward compartments, and goods having an other price in the two outward compartments. In this way it does not matter which face of the ticket is turned upwards during the insertion. It is further possible to increase the price variations by shaping the stamp differently, for instance by using circular, semi-circular or cruciform cross section.

It is evident that the number of compartments in each row will be determined by the required size of the machine, and that the front edge of the ticket may be notched or cut so it will be increasingly difficult to open the machine by means of false tickets.

At an hotel it is possible to supply a guest with a ticket together with the room key. These tickets may be substituted every day, or with any other suitable interval. A returned ticket will inform the staff about the compartments to be replenished.

The magnetically attractible piece 35 must not have such an extension, in the longitudinal direction of the ticket as to interfere with the embossing activity of the stamps. This feature makes it impossible to set the mechanism free for instance by means of a thin knife, as this must pass the stamps and will prevent the operation thereof. Finger 30 is mounted in parallel to the swinging arm 31 carrying the magnet, and must be pushed while the magnet is lifted.

The possibilities of unauthorized use of the machine are thus small, but it is evident that a mechanism of this type cannot be made so strong that it cannot be forced by means of tools.

It is of course desirable that no blocking plate 11 is subjected to any swinging force unitl the catching device is fully released. Plate 28 of this device is designed to actuate a switch 36 in a current circuit 37 feeding a signal lamp 15.

When plate 28 of the catching device remains in the blocking position circuit 37 is broken, but when the plate swings to the open position the circuit will be closed and the lamp is lighted.

What I claim is:

1. A vending machine having a number of compartments arranged in at least one row and a release mechanism box to one side of said at least one row, a blocking means at each compartment, an individual shaft extending from each of said compartments into said release mechanism box and being rotatably mounted in said machine, means for fixedly attaching each blocking means to its corresponding shaft, an embossing mechanism within said box containing axially displaceable embossing stamps corresponding to the number of compartments, levers within said box for operating said stamps and means at each of said shafts for actuating a particular lever, a catching device setable in either of two positions, and adapted in one position to prevent movements of said lever, a passage in said box adapted to permit the insertion of a check ticket having a portion of magnetically attractible material across the path of the axial movement of said embossing stamps, and a release mechanism for said catching device including a detent being magnetically attractible by said check ticket.

2. The vending machine according to claim 1, in which the shafts from a number of compartments located in the same row are concentric.

3. The vending machine according to claim 1, in which the catching device includes an angularly displaceable plate, and the detent includes a magnet mounted upon a swingable arm extending through an opening in said plate and having a notch for cooperating therewith.

4. The vending machine according to claim 1 and including two superimposed rows of compartments, in which shafts at each row are adapted to individually actuate corresponding one-armed levers, the levers corresponding to the lower row of compartments by way of push rods actuating two-armed levers located immediately below the one-armed levers for the upper row of compartments, the catching device being formed as a plate swingable about an axis intermediate its ends so as to block all one-armed levers.

5. The vending machine according to claim 1, provided with a signal lamp, a power supply circuit to said signal lamp, a switch in said circuit, and means operable by the catching device so as to open said switch when the catching device is in blocking position and to close it when said catching device is moved to release position.

* * * * *